US006364680B1

(12) United States Patent
Liu et al.

(10) Patent No.: US 6,364,680 B1
(45) Date of Patent: Apr. 2, 2002

(54) THIN LINE COMMUNICATIONS JACK EXPANSION KIT

(75) Inventors: Sen-Hsiang Liu, Hsi-Chih; Chih-Hao Pan, Taipei; Wei-Chen Tu, Taipei Hsien, all of (TW); Dongfeng Ku, Dong Guan (CN)

(73) Assignee: Primax Electronics Ltd., Taipei (TW)

( * ) Notice: Subject to any disclaimer, the term of this patent is extended or adjusted under 35 U.S.C. 154(b) by 0 days.

(21) Appl. No.: 09/639,831

(22) Filed: Aug. 17, 2000

(51) Int. Cl.[7] ..... H01R 13/62
(52) U.S. Cl. ..... 439/329; 439/77; 439/395
(58) Field of Search ..... 439/329, 77, 492, 439/493, 676, 344, 389, 395, 398, 400, 402, 404

(56) References Cited

U.S. PATENT DOCUMENTS 4,315,664 A * 2/1982 Hughes et al. ..... 439/398
4,555,158 A * 11/1985 Lam ..... 439/404
4,606,595 A * 8/1986 Dola ..... 439/404
5,556,307 A * 9/1996 Johnston ..... 439/676
5,885,111 A * 3/1999 Yu ..... 439/676

* cited by examiner

*Primary Examiner*—Tulsidas Patel
(74) *Attorney, Agent, or Firm*—Winston Hsu

(57) ABSTRACT

A thin line jack expansion module clips onto and electrically connects to a thin line expansion cable. The thin line expansion cable has signal lines for transmitting communications signals. The expansion module has an internal module and an external module. The internal module has a cable bay for accommodating the thin line expansion cable, cable contacts in the cable bay for establishing electrical connections with the signal lines of the thin line expansion cable, and a jack. The jack is electrically connected to the cable contacts. The external module clips onto the internal module and at least partially covers the cable bay. When the thin line expansion cable is set in the cable bay, and the external module is snapped onto the internal module, the cable contacts will electrically connect the jack to the signal lines within the thin line expansion cable.

20 Claims, 4 Drawing Sheets

THIN LINE COMMUNICATIONS JACK EXPANSION KIT

BACKGROUND OF THE INVENTION

1. Field of the Invention

The present invention relates to a communications jack expansion kit. More specifically, the present invention discloses jack modules that can be connected to a specially designed jack extension cable, and which can be used for both telephone wiring and computer network wiring.

2. Description of the Prior Art

Telephone jacks and their associated telephone plugs have a standard design (RJ-11) that enables a user to easily plug a telephone into a telephone network. Computer network wiring utilizes a similar standard, RJ-45. Although the design of these jacks is convenient, their placement or availability in a room is not always so. Frequently, a user may need access to a telephone or computer jack only to find that all available jacks are in use, or that the nearest available jack is located inconveniently far away.

The user has options, of course. In the event that the nearest telephone or computer jack is located too far away, an extension cord may be employed. This is depicted in FIG. 1. A prior art extension cord 14 has a plug 10 on one end for plugging into a jack 12. The jack 12 may be either a computer network jack, or a telephone jack. The other end of the extension cord 14 terminates with a jack 16. The user then plugs into the jack 16 to connect to the telephone or computer network.

The extension cord 14 is of no use, though, if no jacks 12 are available for the plug 10 to plug into. This is quite a common occurrence in office environments where a plethora of fax machines, telephones, modems and networking equipment quickly use all available jacks 12. In this case, the user must buy an adapter that coverts a single jack into two jacks. Such an adapter is depicted in FIG. 2. A jack expansion adapter 20 has a plug 22 for plugging into a jack 24. Once plugged into the jack 24, the expansion adapter 20 has two jacks 26 that a user may use to connect to the telephone or computer network.

The extension cord 14 and expansion adapter 20 are straightforward designs that are easy to use. They are not, however, very flexible. For example, the user may end up with a large amount of excess cable tangled under his or her desk when using the extension cord 14, as the vast majority of users are unwilling to cut and splice the cable 14 to an optimum required length. On the other hand, the expansion adapter 20 may not offer enough extra jacks 26, and the jacks 26 that are provided may require the extension cord 14 to bring them to within working distance of the user.

SUMMARY OF THE INVENTION

It is therefore a primary objective of this invention to provide a thin line communications jack expansion kit that permits a user to flexibly position as many jacks as he or she may require, using as little cable as necessary. The jacks may be utilized for computer networks, telephone networks or other similarly wired networks.

The present invention, briefly summarized, discloses a thin line jack expansion module that clips onto and electrically connects to a thin line expansion cable. The thin line expansion cable has signal lines for transmitting communications signals. The expansion module has an internal module and an external module. The internal module has a cable bay for accommodating the thin line expansion cable, cable contacts in the cable bay for establishing electrical connections with the signal lines of the thin line expansion cable, and a jack. The jack is electrically connected to the cable contacts. The external module clips onto the internal module and at least partially covers the cable bay. When the thin line expansion cable is set in the cable bay, and the external module is snapped onto the internal module, the cable contacts will electrically connect the jack to the signal lines within the thin line expansion cable.

It is an advantage of the present invention that as many expansion jack modules as the user may require can be clipped onto the thin line expansion cable. Furthermore, the expansion modules can be clipped onto the cable at any point so that the cable can efficiently strung, the expansion jacks being clipped onto it at exactly those points here they are needed.

These and other objectives of the present invention will no doubt become obvious to those of ordinary skill in the art after reading the following detailed description of the preferred embodiment, which is illustrated in the various figures and drawings.

DETAILED DESCRIPTION OF THE PREFERRED EMBODIMENT

Figure 1:
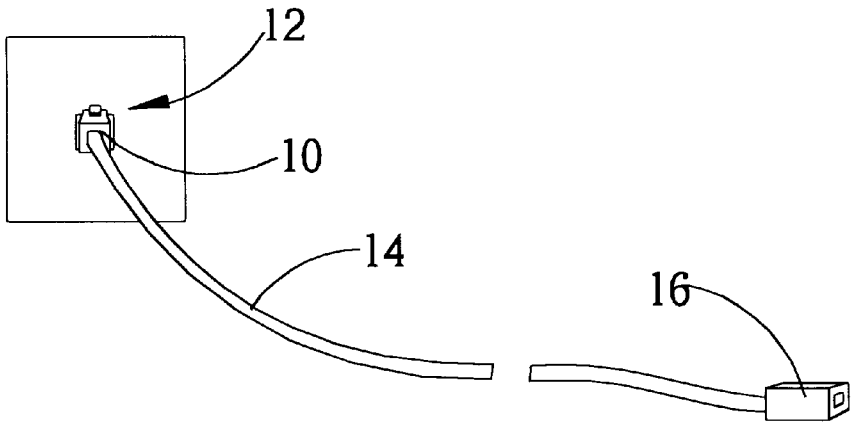
Fig. 1 Prior art
FIG. 1 is a diagram of a prior art extension cord.
Figure 2:
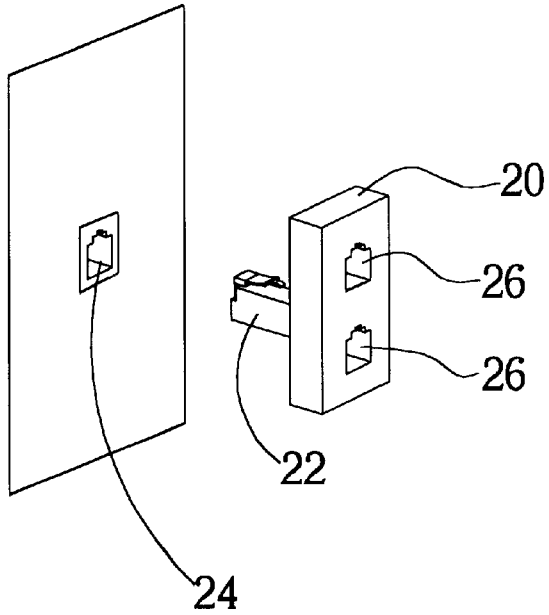
Fig. 2 Prior art
FIG. 2 is a diagram of a prior art jack expansion module.
Figure 3:
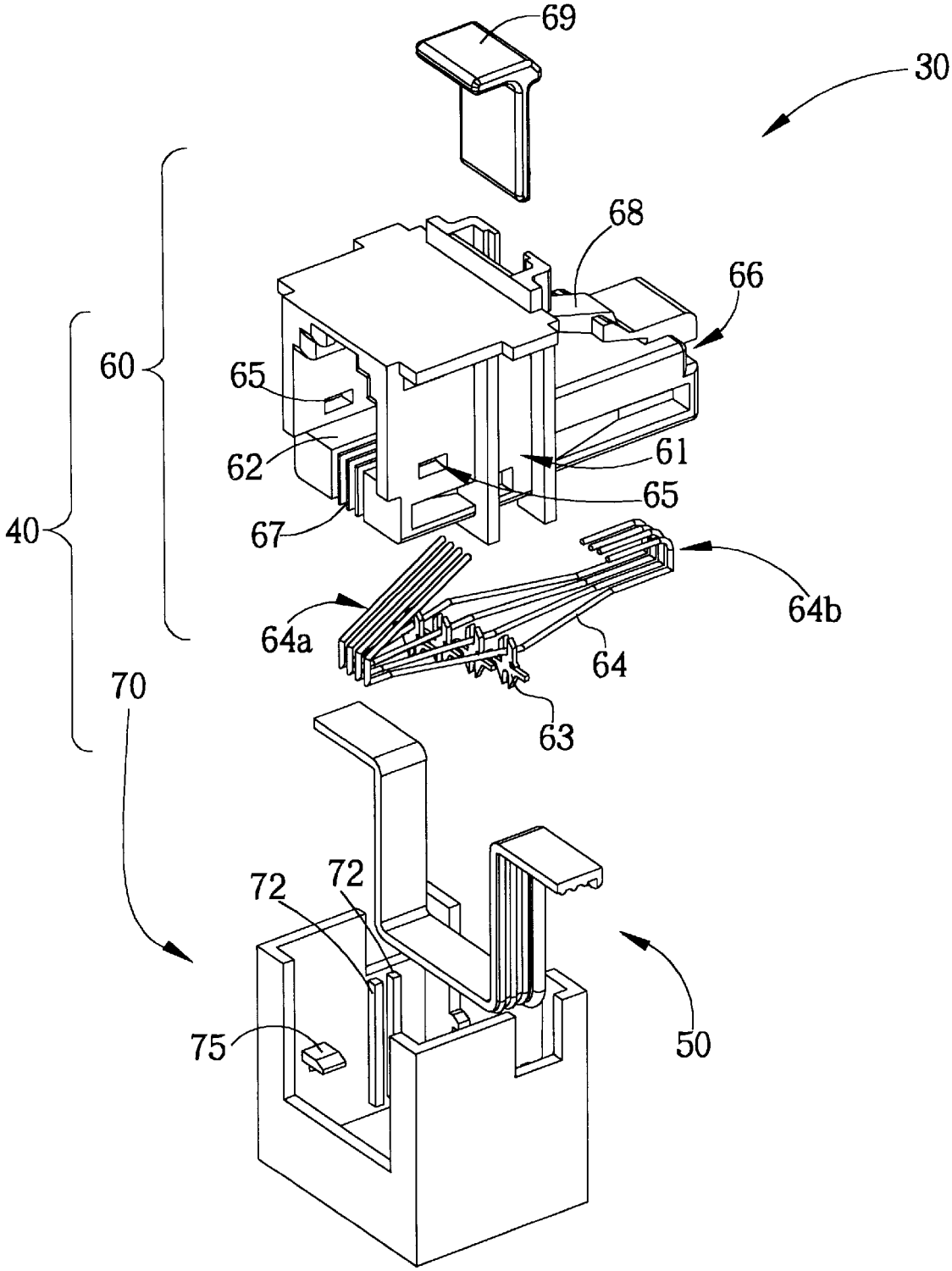
FIG. 3 is an exploded view diagram of a first embodiment present invention communications jack expansion kit.

Please refer to FIG. 3. FIG. 3 is an exploded view diagram of a first embodiment of a present invention communications jack expansion kit 30. The thin line communications jack expansion kit 30 comprises a thin line jack expansion module 40 and a thin line expansion cable 50. The jack expansion module 40 comprises an internal module 60 and an external module 70. The external module 70 slides over the internal module 60 and then locks onto the internal module 60. When it does so, the thin line expansion cable 50 is sandwiched between the internal module 60 and the external module 70.

The internal module 60 comprises a cable bay 61, a plurality of cable contacts 63, a jack 62 and a plug 66. The cable bay 61 is designed to accommodate the thin line expansion cable 50. That is, when clipping the expansion module 40 onto the thin line expansion cable 50, the cable 50 is set in the cable bay 61 so that it wraps around three sides of the internal module 60. The user then snaps the external module 70 onto the internal module 60, thereby securing the cable inside the expansion module 40. The cable contacts 63 are blades with a thin gold coating to improve their electrical conductivity, and they are disposed within the cable bay 61 on one side of the internal module 60.

The jack 62 accommodates a user telephone plug (not shown) or a computer network plug (not shown), permitting a user to plug a communications device into the thin line jack expansion module 40. The type of plug which is accommodated will depend upon the type of wiring the user wishes to set up, i.e., either setting up additional jacks for a computer network, or for a telephone network. In most cases, it is not possible to mix telephone wiring (RJ-11) with computer network wiring (RJ-45). In the same vein, the plug 66 enables the thin line jack expansion module 40 to be plugged into a user jack (not shown), such as a computer network jack or a telephone network jack, and in this way the thin line jack expansion module 40 establishes a connection to a communications network. The design of these communications jacks and plugs requires that they have contacts to establish electrical connections with their mates. The jack 62 and plug 66 share their contacts by way of a plurality of wires 64, and so are electrically connected to each other. One end of the wires forms a plurality of jack signal contacts 64*a*. The other end of the wires forms a plurality of plug signal contacts 64*b*. The wires 64 wrap around the internal module 60 in a series of grooves 67 from the jack 62 to the plug 66. As shown in FIG. 3, each wire 64 has a cable contact 63. In this manner, both the jack signal contacts 64*a* and the plug signal contacts 64*b* are electrically connected to their respective cable contacts 63. In accordance with the design of RJ-11 and RJ-45 plugs, the plug 66 also comprises a locking mechanism 68 and a release mechanism 69. The locking mechanism 68 is simply a flexible tab that engages with and locks to a user communications jack. The release mechanism 69 simply allows a user to depress the locking mechanism 68 so as to unlock it from the user communications jack.

The internal module 60 also has a number of holes 65 in its structure. These holes 65 engage with corresponding tabs 75 on the external module 70. When the external module 70 is slid over the internal module 60, it covers the cable bay 61 to secure the thin line expansion cable 50, and the tabs 75 snap into their respective holes 65 to lock the external module 70 to the internal module 60. By inserting the tip of a pin, or the point of a knife blade into the holes 65, the user may unlock the external module 70 from the internal module 60.

Figure 4:
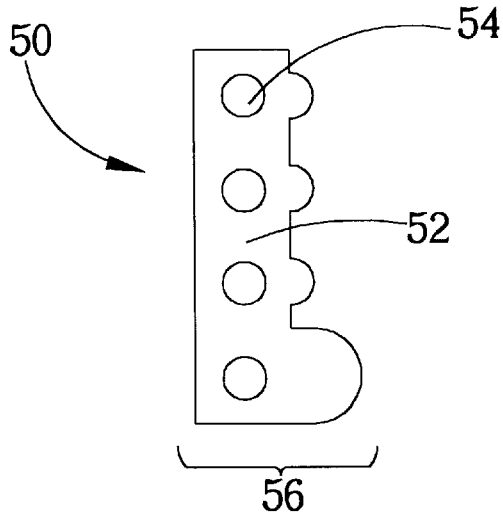
FIG. 4 is a cross-sectional view of a thin line expansion cable shown in FIG. 3.

Please refer to FIG. 4 in conjunction with FIG. 3. FIG. 4 is a cross-sectional view of the thin line expansion cable 50. As shown in the figures, the cable 50 has a relatively flat, L-shaped structure. The cable 50 has an insulating substrate 52, which is made of PVC. Running linearly along the length of the cable 50, and disposed within the substrate 52, is a plurality of electrically conductive signal lines 54. The preferred embodiment has four such signal lines 54 to accommodate the RJ-11 standard, and they are made of copper. Alternatively, eight signal lines 54 may be used to accommodate the RJ-45 standard. The signal lines 54 are used to transmit communications signals along the length of the thin line expansion cable 50. Finally, the cable 50 has a ridge 56, giving the cable 50 its L-shaped cross-section. The relatively thin cross-section of the cable 50 makes it easy to conceal under carpet, or kept tucked close to walls and wainscoting. The insulating substrate 52 can also be made transparent to further reduce the visibility of the thin line expansion cable 50.

Figure 5:
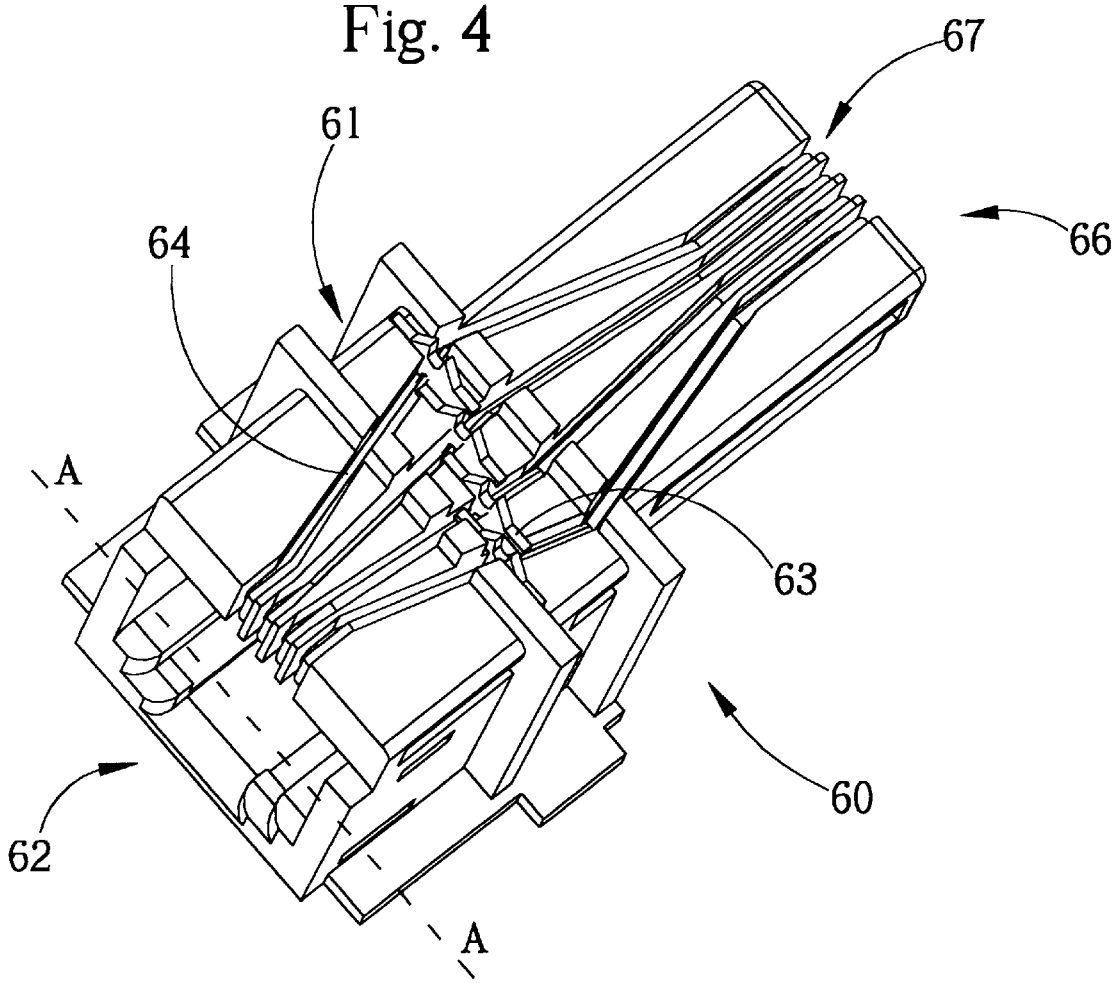
FIG. 5 is a perspective view of an internal module shown in FIG. 3.

Please refer to FIG. 5 in conjunction with FIG. 3. FIG. 5 is a perspective view of the internal module 60. As shown in FIG. 5, the grooves 67 run around the internal module 60 from the jack 62 to the plug 66, flaring at the cable bay 61. The flaring permits ample separation between the blade-like cable contacts 63. Within each groove 67 runs a wire 64 that forms respective contacts at both the jack 62 and plug 66. Each wire 64 is in electrical contact with its respective cable contact 63. When the thin line expansion cable 50 lies flat in the cable bay 61 and is pressed into the cable contacts 63 by the locking of the external module 70 to the internal module 60, the blade-like cable contacts 63 pierce through the insulating substrate 52 of the thin line expansion cable 50. The disposition of the cable contacts 53 in the cable bay 61 is such that each cable contact will penetrate through the insulating substrate 52 to establish an electrical contact with one of the signal lines 54. In this manner, the thin line jack expansion module 40 establishes an electrical connection with the thin line expansion cable 50, and uses the cable 50 to transmit and receive communications signals for both its plug 66 and jack 62. Thus, a user plug (not shown), plugged into the jack 62, can send and receive communications signals along the cable 50, such as telephonic or computer network signals. Similarly, when the plug 66 is plugged into a user jack (not shown), the user jack can also send and receive communications signals along the cable 50.

If the jack expansion modules 40 were to be clipped onto the thin line expansion line 50 with different orientations with respect to each other, polarization and signal crossing problems would occur. This can be confusing for many users. The present invention jack expansion kit 30 has been designed to ensure that the external module 70 will lock onto the internal module 60 only when the thin line expansion cable 50 is disposed within the cable bay 61 with a proper orientation. This provides a foolproof design for the jack expansion kit 30. When the external module 70 refuses to lock onto the internal module 60, the user will immediately know that he or she is attempting an improper configuration. By rotating the modules 60 and 70 around the cable 50, the user can achieve the proper orientation, whereupon the external module 70 will snap onto the internal module 60. The jack 62 and plug 66 of the jack expansion module 40 will then be electrically connected to the cable 50 via the cable contacts 63.

Figure 6:
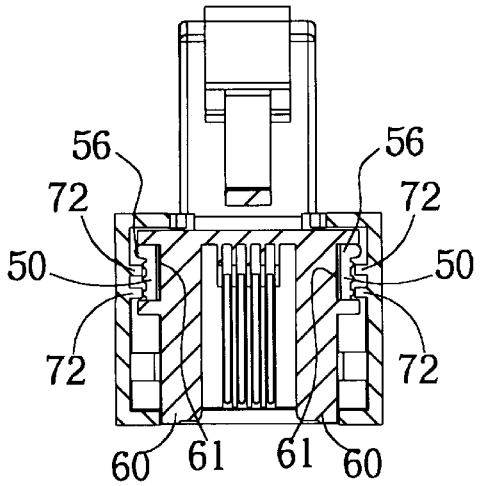
FIG. 6 is a cross-sectional view of a jack expansion module when it is properly configured with a thin line expansion cable.

Please refer to FIG. 6 in conjunction with FIG. 3. FIG. 6 is a cross-sectional view of the jack expansion module 40 when it is properly configured with the thin line expansion cable 50. The external casing has several ribs 72 that are disposed so that they will be over the cable bay 61 when the external module 70 is slid onto the internal module 60. The ribs 72 will engage with the cable 50 if the cable 50 is improperly oriented in the cable bay 61. For example, for the modules to lock together, the cable must lie flat in the cable bay 61. This is possible only if the ridge 56 of the cable 50 faces outward away from the surface of the cable bay 61. If it does not, the ribs 72 will strike the body of the cable 50, and the user will not be able to get the two modules 60 and 70 to snap together. Similarly, if the cable 50 lies flat in the cable bay 61, but is rotated 180 degrees from the correct orientation, the ridge 56 will strike the ribs 72 and the modules 60 and 70 will not lock together. Thus, the disposition of the ridge 56 in the cable bay 61 will prevent the external module 70 from locking onto the internal module 60 if the cable 50 is incorrectly oriented in the cable bay 61.

Figure 7:
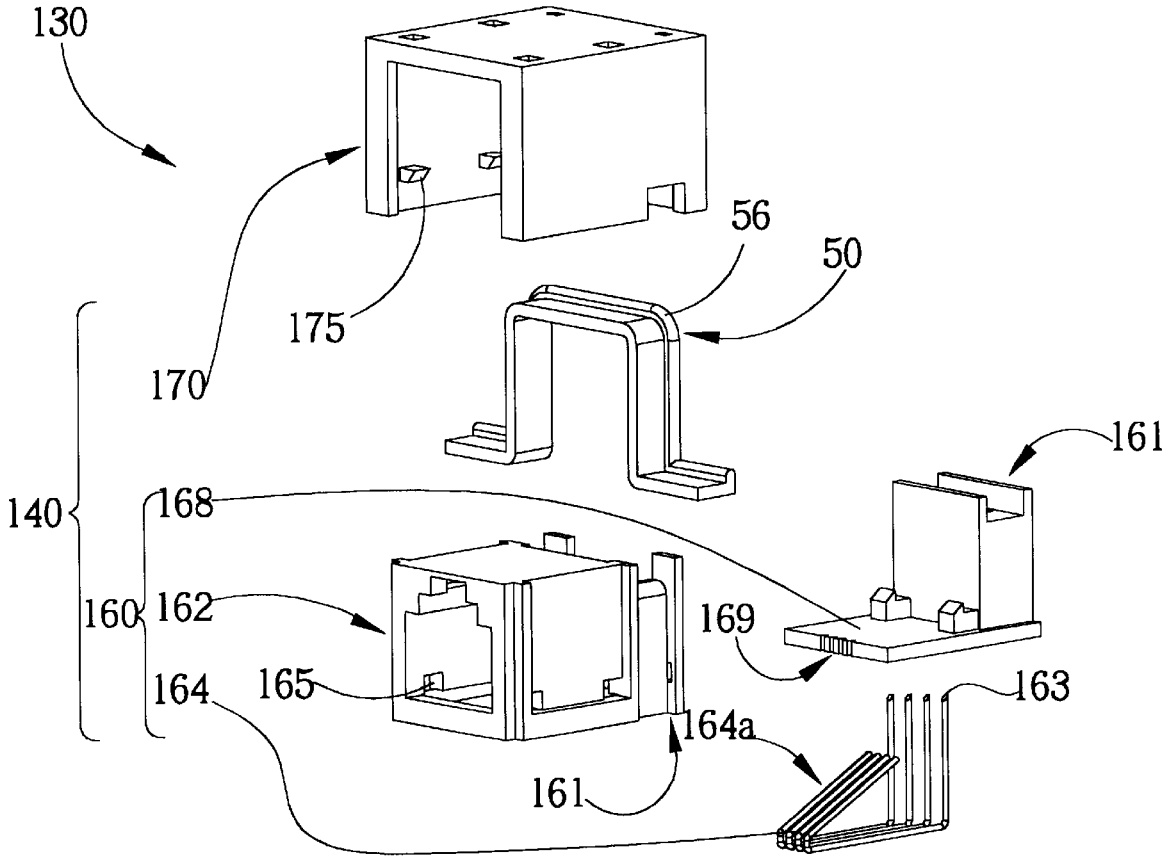
FIG. 7 is an exploded view of a second embodiment of the present invention.

Please refer to FIG. 7. FIG. 7 is an exploded view of a second embodiment of the present invention, a communications jack expansion kit 130. The communications jack expansion kit 130 comprises a jack expansion module 140, and the thin line expansion cable 50, which has already been disclosed. In basic function, the jack expansion module 140 is much like the jack expansion module 40, except that it does not have a plug. Also, the blade-like cable contacts 63 of the first embodiment have a simplified structure in the second embodiment. The jack expansion module 140 comprises an internal module 160 and an external module 170. The internal module 160 and the external module 170 clip together, sandwiching the thin line expansion cable 50 between them, and in so doing establish an electrical connection between the cable 50 and the jack expansion module 140.

The internal module 160 comprises a jack 162, a plurality of wires 164, a secondary module 168 and a cable bay 161. The cable bay 161 is on both the jack 162 and the secondary module 168, and wraps around three sides of the internal module 160. One end of the wires 164 is sharpened to form cable contacts 163 that pierce through the cable 50 to establish electrical connections with the signal wires (not shown) inside the cable 50. The cable contacts 163 stick out from the cable bay 161 of the secondary module 168. The other ends of the wires 164 run down from the cable bay 161, around the bottom of the secondary module 168, and bend around notches 169 to form a plurality of jack signal contacts 164*a*. The secondary module 168 is then inserted into the jack 162 to complete the structure of the internal module 160. As in the first embodiment, the internal module 160 has holes 165 that engage with corresponding tabs 175 on the external module 170 to snap the two modules together.

When the cable 50 is disposed in the cable bay 161 with the proper orientation and the external module 170 is slid onto the external module 170, the sharpened cable contacts 163 will pierce the insulation of the cable 50 and the modules will lock together. Each wire 164 thus establishes an electrical connection with its corresponding signal wire (not shown) in the cable 50, and in this manner the jack signal contacts 164*a* become electrically connected to the cable 50. A user communications plug, plugged into the jack 162, can then transmit and receive communications signals, such as telephonic or networking signals, on the cable 50. As in the first embodiment, the internal module 160 will not lock onto the external module 170 if the cable 50 is disposed in the cable bay 161 with an improper orientation. As explained in the first embodiment, this is ensured by the ridge 56 on the cable 50 interacting with the external module 170. The cable 50 must lie flat in the cable bay 161, and be properly oriented so that the ridge 56 will not engage with a corresponding ridge (not shown) on the external module 170.

Using the present invention communications jack expansion kits 30 and 130 is quite straightforward. A user clips the jack expansion module 40 or 140 onto the thin line expansion line 50, the proper orientation of the modules 40 and 140 being assured, as explained above. No special tools, pliers or screwdrivers are required to do this. The plug 66 is then plugged into a user jack, such as a telephone jack or a computer-networking jack. The pass-through nature of the plug 66 with the jack 62 makes the jack 62 immediately available for use. The user can then run out exactly as much cable 50 as he or she may require, cutting it to the desired length. At the other end of the cable 50, the user can clip on another jack expansion module 40, or the module 140. Indeed, several such modules 40 and 140 can be clipped on to the cable 50 at any interval along its length, permitting the user to establish as many extra jacks 66 and 166 as he or she may require, at any position desired. Furthermore, the thin nature of the cable 50 ensures that it is as discreet as possible.

In contrast to the prior art, the present invention utilizes a jack expansion module, which can clip onto a thin line telephone expansion cable at any point along the length of the cable. The design of both the cable and the module ensures that the module will clip onto the cable correctly, avoiding reversed polarities and incorrect signals. The jack expansion module has an internal and an external module, which clip together, sandwiching the cable between them and electrically connecting the jack expansion module to the thin line expansion cable.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A thin line jack expansion module adapted to electrically connect to a thin line expansion cable comprising a plurality of electrically conductive signal lines for transmitting communications signals, the expansion module comprising:

an internal module comprising:

a cable bay for accommodating the thin line expansion cable;

a plurality of electrically conductive cable contacts disposed within the cable bay and adapted to establish electrical connections with the signal lines of the thin line expansion cable; and a jack for accommodating a user communications plug, the jack comprising a plurality of jack signal contacts, the jack signal contacts electrically connected to the cable contacts; and an external module for at least partially covering the cable bay of the internal module, the external module capable of locking onto the internal module and comprising a rib for mechanically interacting with the thin line expansion cable to permit only one proper orientation of the thin line expansion cable within the cable bay;

wherein when the thin line expansion cable is disposed in the cable bay with the only one proper orientation, the rib permits the external module to be locked onto the internal module so that the cable contacts are capable of electrically connecting the jack signal contacts to the signal lines within the thin line expansion cable so that a user communications plug plugged into the jack can receive and transmit communications signals along the thin line expansion cable, and when the thin line expansion cable is disposed in the cable bay with an orientation that is not the proper orientation, mechanical interaction of the rib with the thin line expansion cable prevents the external module from locking onto the internal module.

2. The thin line jack expansion module of claim 1 wherein the thin line jack expansion module is adapted to accommodate the thin line expansion cable comprising an electrically insulating substrate, signal lines being disposed within the insulating substrate, and the insulating substrate comprising at least a ridge; wherein if the thin line expansion cable is disposed in the cable bay with an orientation that is not the proper orientation, the disposition of the ridge interacts with the rib to prevent the external module from locking onto the internal module.

3. The thin line jack expansion module of claim 2 wherein the ridge engages with the external module to prevent the external module from locking onto the internal module if the thin line expansion cable is disposed in the cable bay with an improper orientation.

4. The thin line jack expansion module of claim 2 wherein the cable contacts are blade contacts that pierce through the insulating substrate to establish electrical connections with the signal lines when the external module is locked onto the internal module.

5. The thin line jack expansion module of claim 1 wherein the internal module further comprises a plug for plugging into a user communications jack, the plug comprising a plurality of plug signal contacts electrically connected to the cable contacts; wherein when the thin line expansion cable is disposed in the cable bay, and the external module is locked onto the internal module, the cable contacts will electrically connect the plug signal contacts to the signal lines within the thin line expansion cable so that when the plug is plugged into the user communications jack, the user communications jack can receive and transmit communications along the thin line expansion cable.

6. The thin line jack expansion module of claim 5 wherein each jack signal contact is electrically connected to a corresponding plug signal contact.

7. The thin line jack expansion module of claim 6 wherein wires are used to form the jack signals contacts, and these wires wrap around the internal module to the plug to form the corresponding plug signal contacts.

8. The thin line jack expansion module of claim 5 wherein the jack and the plug can be used for telephone networks or for computer networks.

9. The thin line jack expansion module of claim 8 wherein the plug and the jack conform to RJ-11 specifications or to RJ-45 specifications.

10. The thin line jack expansion module of claim 1 wherein the cable bay spans three sides of the internal module, and the external module at least partially covers the three sides of the internal module.

11. A thin line communications jack expansion kit comprising:

a thin line expansion cable comprising a plurality of electrically conductive signal lines adapted to transmit communications signals; and an expansion module comprising:

an internal module comprising:

a cable bay for accommodating the thin line expansion cable;

a plurality of electrically conductive cable contacts disposed within the cable bay for establishing electrical connections with the signal lines of the thin line expansion cable; and a jack for accommodating a user communications plug, the jack comprising a plurality of jack signal contacts, the jack signal contacts electrically connected to the cable contacts; and an external module for at least partially covering the cable bay of the internal module, the external module capable of locking onto the internal module;

wherein when the thin line expansion cable is disposed in the cable bay with only one proper orientation, and the external module is locked onto the internal module, the cable contacts electrically connect the jack signal contacts to the signal lines within the thin line expansion cable so that a user communications plug plugged into the jack receives and transmits communications signals along the thin line expansion cable, and when the thin line expansion cable is disposed in the cable bay with an orientation that is not the proper orientation, the thin line expansion cable mechanically interacts with the expansion module to prevent the external module from locking onto the internal module.

12. The thin line communications jack expansion kit of claim 11 wherein the thin line expansion cable comprises an electrically insulating substrate, the signal lines being disposed within the insulating substrate, and the insulating substrate comprises at least a ridge; wherein if the thin line expansion cable is disposed in the cable bay with an orientation that is not the proper orientation, the disposition of the ridge prevents the external module from locking onto the internal module.

13. The thin line communications jack expansion kit of claim 12 wherein the external module comprises a rib adapted to engage with the thin line expansion cable; wherein the rib engages with the ridge to prevent the external module from locking onto the internal module if the thin line expansion cable is disposed in the cable bay with an orientation that is not the proper orientation.

14. The thin line communications jack expansion kit of claim 12 wherein the cable contacts are blade contacts capable of piercing the insulating substrate to establish electrical connections with the signal lines when the external module is locked onto the internal module, each cable contact electrically connecting to a separate jack signal contact.

15. The thin line communications jack expansion kit of claim 11 wherein the internal module further comprises a plug adapted to plug into a user communications jack, the plug comprising a plurality of plug signal contacts electrically connected to the cable contacts; wherein when the thin line expansion cable is disposed in the cable bay, and the external module is locked onto the internal module, the cable contacts electrically connect the plug signal contacts to the signal lines within the thin line expansion cable so that when the plug is plugged into a user communications jack, the user communications jack receives and transmits communications along the thin line expansion cable.

16. The thin line communications jack expansion kit of claim 15 wherein each jack signal contact is electrically connected to a corresponding plug signal contact.

17. The thin line communications jack expansion kit of claim 16 wherein wires are used to form the jack signals contacts, and the wires wrap around the internal module to the plug to form the corresponding plug signal contacts.

18. The thin line communications jack expansion kit of claim 15 wherein the jack and the plug are capable of being used for telephone networks or for computer networks.

19. The thin line communications jack expansion kit of claim 18 wherein the plug and the jack conform to RJ-11 specifications or to RJ-45 specifications.

20. The thin line communications jack expansion kit of claim 11 wherein the cable bay spans three sides of the internal module, and the external module at least partially covers the three sides of the internal module.

* * * * *

UNITED STATES PATENT AND TRADEMARK OFFICE

CERTIFICATE OF CORRECTION

PATENT NO. : 6,364,680 B1
DATED : April 2, 2002
INVENTOR(S) : Liu et al.

It is certified that error appears in the above-identified patent and that said Letters Patent is hereby corrected as shown below:

Title page,
Item [*] Notice, delete the phrase “by 0 days” and insert -- by 48 days --

Signed and Sealed this

Twenty-first Day of September, 2004

JON W. DUDAS
*Director of the United States Patent and Trademark Office*